US005643113A

United States Patent [19]

Rodgers

[11] Patent Number: 5,643,113

[45] Date of Patent: Jul. 1, 1997

[54] ADJUSTABLE TEE SETTING DEVICE

[76] Inventor: John Rodgers, 3808 Morningside Dr. N., Ellenton, Fla. 34222

[21] Appl. No.: 528,929

[22] Filed: Sep. 15, 1995

[51] Int. Cl.[6] ..... A63B 57/00

[52] U.S. Cl. ..... 473/386; 473/408; 473/282; 273/DIG. 30

[58] Field of Search ..... 473/386, 282, 473/408; 273/DIG. 30

[56] References Cited

U.S. PATENT DOCUMENTS 2,606,764 8/1952 Mason ..... 473/386

4,313,604 2/1982 Baxter ..... 473/386 X 5,031,812 7/1991 Gustine ..... 273/DIG. 30

*Primary Examiner*—George J. Marlo

[57] ABSTRACT

A device for facilitating forced insertion of a golf tee into a ground surface at a predetermined height. The inventive device includes a clamp for engaging a shaft of a golf tee. A positioning screw engages a head of the golf tee such that a predetermined length of the shaft projects beyond the clamp for insertion into the ground.

1 Claim, 3 Drawing Sheets

ADJUSTABLE TEE SETTING DEVICE

BACKGROUND OF THE INVENTION

1. Field of the Invention

The present invention relates to golf tee handling structures and more particularly pertains to an adjustable tee setting device for facilitating forced insertion of a golf tee into a ground surface at a predetermined height.

2. Description of the Prior Art

The use of golf tee handling structures is known in the prior art. More specifically, golf tee handling structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf tee handling structures include U.S. Pat. No. 4,989,868; U.S. Pat. No. 3,840,229; U.S. Pat. No. 3,312,468; U.S. Pat. No. 3,206,197; U.S. Pat. No. 4,949,961; U.S. Pat. No. 5,242,161; U.S. Pat. No. 5,080,357; U.S. Pat. No. 4,142,719; U.S. Pat. No. 4,660,837; U.S. Pat. No. 3,671,037; U.S. Pat. No. 3,220,727; U.S. Pat. No. 3,540,727; U.S. Pat. No. 3,658,331; U.S. Pat. No. 4,951,947; U.S. Pat. No. 3,074,719; and U.S. Pat. No. 4,896,883.

While these devices fulfill their respective, particular objectives and requirements, the aforementioned patents do not disclose an adjustable tee setting device for facilitating forced insertion of a golf tee into a ground surface at a predetermined height which includes a clamp for engaging a shaft of a golf tee, and a positioning screw engaging a head of the golf tee such that a predetermined length of the shaft projects beyond the clamp for insertion into the ground.

In these respects, the adjustable tee setting device according to the present invention substantially departs from the conventional concepts and designs of the prior art, and in so doing provides an apparatus primarily developed for the purpose of facilitating forced insertion of a golf tee into a ground surface at a predetermined height.

SUMMARY OF THE INVENTION

In view of the foregoing disadvantages inherent in the known types of golf tee handling structures now present in the prior art, the present invention provides a new adjustable tee setting device construction wherein the same can be utilized for facilitating forced insertion of a golf tee into a ground surface at a predetermined height. As such, the general purpose of the present invention, which will be described subsequently in greater detail, is to provide a new adjustable tee setting device apparatus and method which has many of the advantages of the golf tee handling structures mentioned heretofore and many novel features that result in a adjustable tee setting device which is not anticipated, rendered obvious, suggested, or even implied by any of the prior art golf tee handling structures, either alone or in any combination thereof.

To attain this, the present invention generally comprises a device for facilitating forced insertion of a golf tee into a ground surface at a predetermined height. The inventive device includes a clamp for engaging a shaft of a golf tee. A positioning screw engages a head of the golf tee such that a predetermined length of the shaft projects beyond the clamp for insertion into the ground.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable tee setting device apparatus and method which has many of the advantages of the golf tee handling structures mentioned heretofore and many novel features that result in a adjustable tee setting device which is not anticipated, rendered obvious, suggested, or even implied by any of the prior art tool guides, either alone or in any combination thereof.

It is another object of the present invention to provide a new adjustable tee setting device which may be easily and efficiently manufactured and marketed.

It is a further object of the present invention to provide a new adjustable tee setting device which is of a durable and reliable construction.

An even further object of the present invention is to provide a new adjustable tee setting device which is susceptible of a low cost of manufacture with regard to both materials and labor, and which accordingly is then susceptible of low prices of sale to the consuming public, thereby making such adjustable tee setting devices economically available to the buying public.

Still yet another object of the present invention is to provide a new adjustable tee setting device which provides in the apparatuses and methods of the prior art some of the advantages thereof, while simultaneously overcoming some of the disadvantages normally associated therewith.

Still another object of the present invention is to provide a new adjustable tee setting device for facilitating forced insertion of a golf tee into a ground surface at a predetermined height.

Yet another object of the present invention is to provide a new adjustable tee setting device which includes a clamp for engaging a shaft of a golf tee, and a positioning screw engaging a head of the golf tee such that a predetermined length of the shaft projects beyond the clamp for insertion into the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
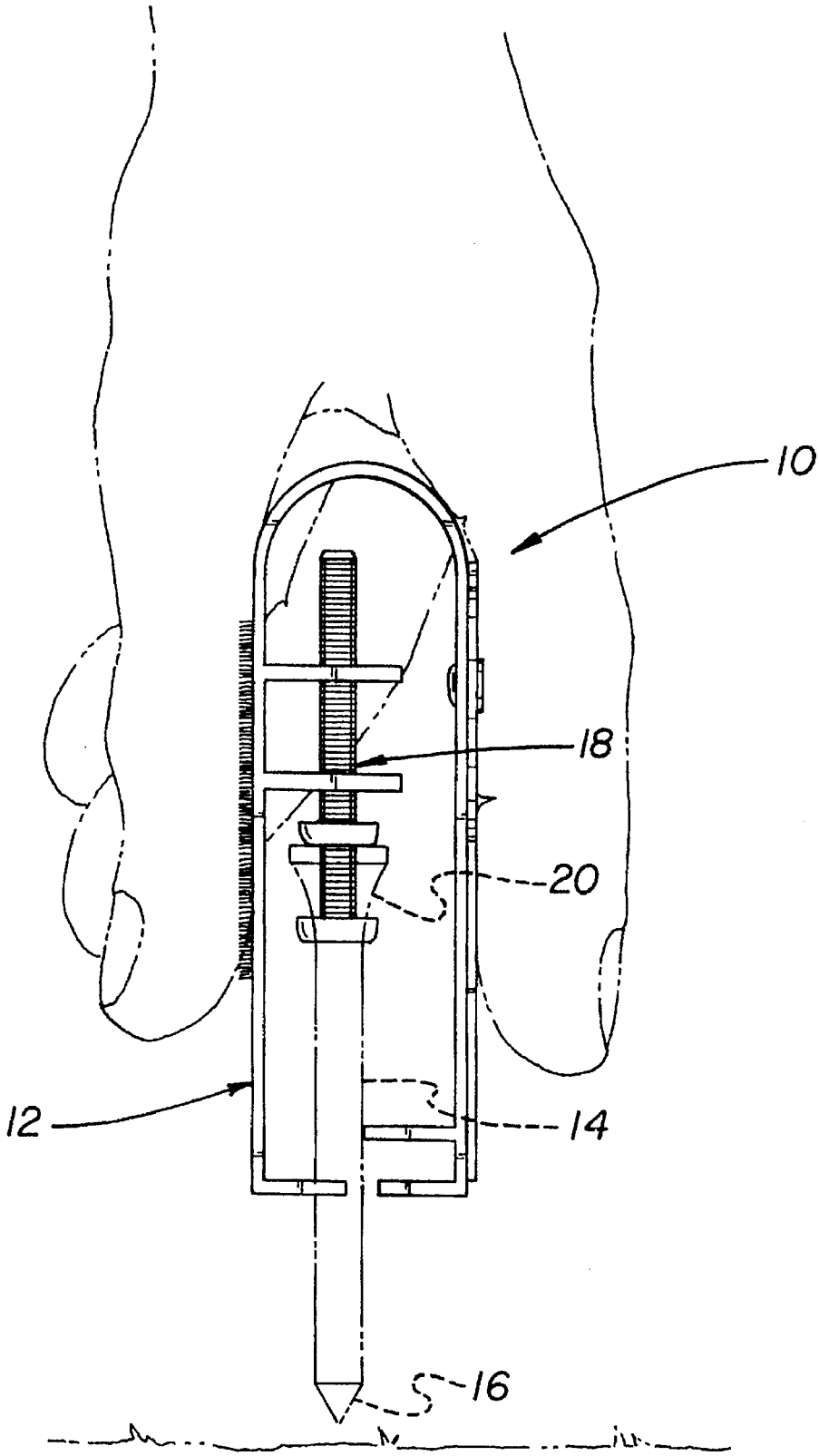
FIG. 1 is an elevation view of an adjustable tee setting device according to the present invention in use.

With reference now to the drawings, and in particular to FIGS. 1–5 thereof, a new adjustable tee setting device embodying the principles and concepts of the present invention and generally designated by the reference numeral 10 will be described.

More specifically, it will be noted that the adjustable tee setting device 10 comprises a clamp means 12 for clamping a shaft 14 of a golf tee 16 substantially as shown in FIG. 1 of the drawings. A positioning means 18 is adjustably mounted relative to the clamp means 12 and operates for engaging a head 20 of the golf tee 16 so as to adjustably position the golf tee relative to the clamp means 12 such that a predetermined amount of the shaft 14 thereof projects beyond the clamp means for forced insertion into a ground surface. By this structure, an individual can effect repeated insertion of golf tees into ground surface at a consistent and constant height.

Referring now to FIGS. 2 through 5 wherein the present mentioned 10 is illustrated in detail, it can be shown that the clamp means 12 of the present invention 10 further comprises a first clamp plate 22 having a second clamp plate 24 resiliently pivotally mounted to the first clamp plate 22 by a resilient hinge 26 extending therebetween. Preferably, the resilient hinge 26 is an integral bend extending between upper ends of the clamp plates 22 and 24. A first engaging plate 28 is mounted to a lower end of the first clamp plate 22 and projects towards the second clamp plate 24. Similarly, at least one second engaging plate 30 is mounted to the lower end of the second clamp plate 24 and projects towards the first clamp plate 22. Preferably, the present invention 10 includes a pair of spaced and parallel second engaging plates 30 which are configured to extend along opposed sides of the first engaging plate 28 as the second clamp plate 24 is biased towards the first clamp plate 22. The first engaging plate 28 includes a receiving aperture 32 directed thereinto which operates to receive a portion of the shaft 14 of the golf tee 16 when the device 10 is utilized as shown in FIG. 1 of the drawings. By this structure, the golf tee 16 can be securely held between the clamp plates 22 and 24 for forced insertion into a ground surface.

With continuing reference to FIGS. 2 through 5, it can be shown that the positioning means 18 of the present invention 10 preferably comprises at least one mounting plate 36 coupled to an interior surface of one of the clamp plates 22 or 24. Preferably, the positioning means 18 includes a pair of substantially spaced and parallel mounting plates 36 extending along an interior surface of the first clamp plate 22. An adjustment screw 38 is threadably directed through the mounting plates 36 and is aligned with the receiving aperture 32 such that a longitudinal axis directed through the adjustment screw 38 projects through the receiving aperture as well. The adjustment screw 38 can thus be rotatably axially advanced relative to the mounting plates 36 so as to be positioned a desired distance from the first engaging plate 28 such that when a hemi-spherical head 40 of the adjustment screw 38 engages the head 20 of the golf tee 16, a predetermined mount of the shaft 14 thereof will project beyond the engaging plates 28 and 30 of the clamp means 12.

Figure 2:
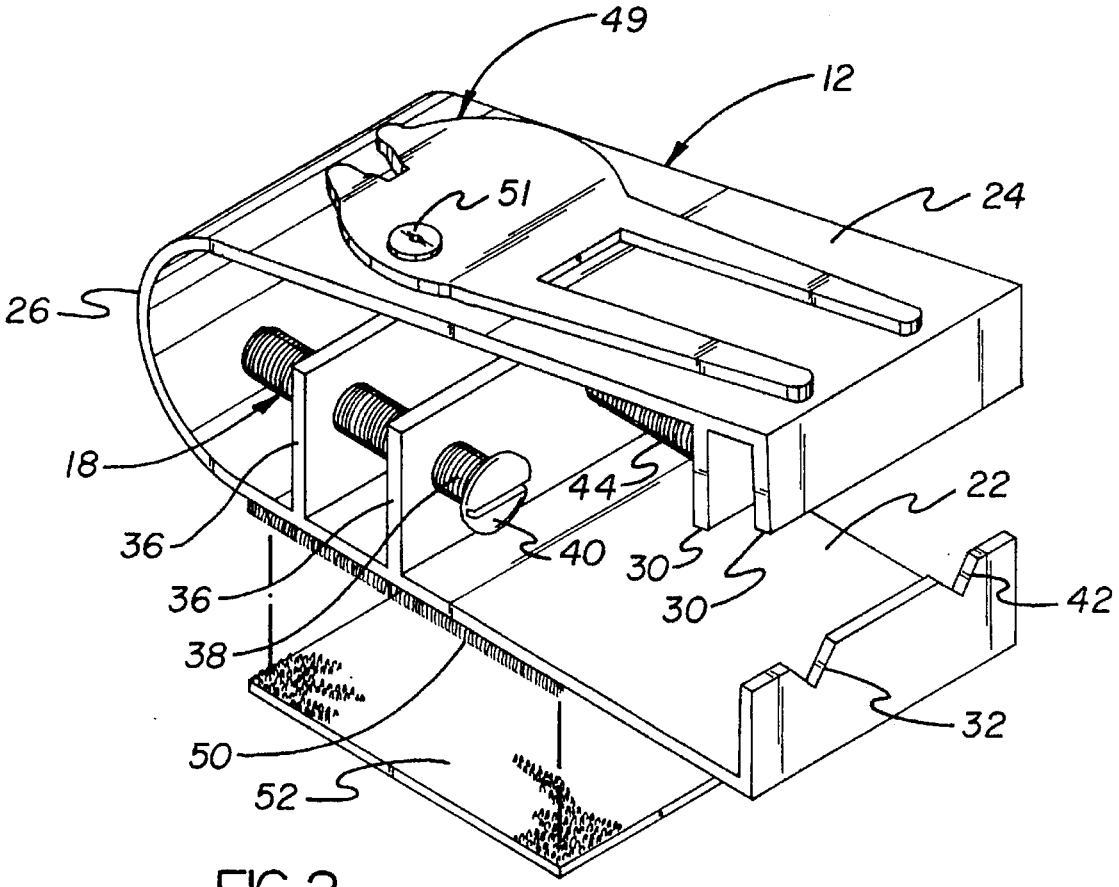
FIG. 2 is an isometric illustration of the invention, per se.
Figure 3:
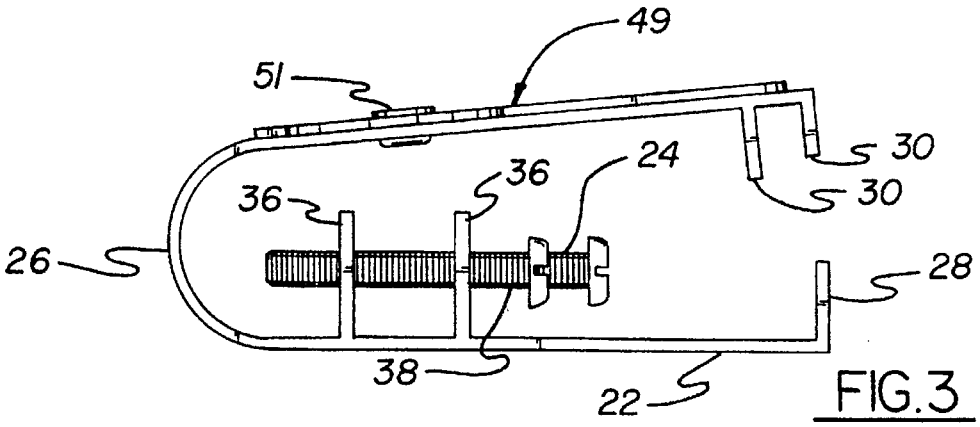
FIG. 3 is a side elevation view thereof.
Figure 4:
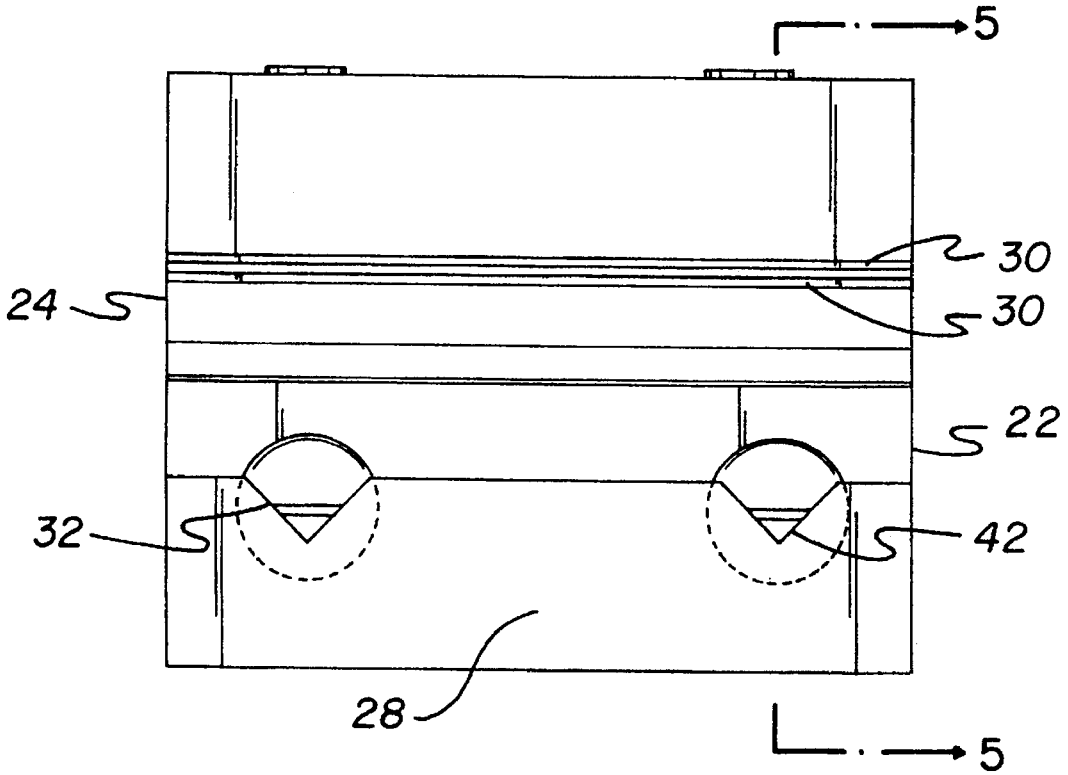
FIG. 4 is an end elevation view of the invention.
Figure 5:
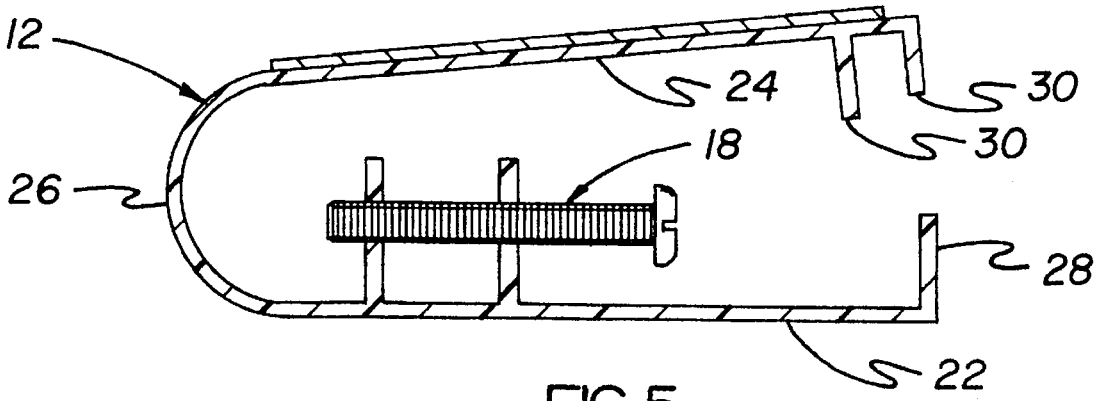
FIG. 5 is a cross sectional view taken along line 5—5 of FIG. 4.

As best illustrated in FIGS. 2 and 4, it can be shown that the present invention 10 may be configured so as to accommodate more than one block tee 16. In this respect, the first engaging plate 28 may further include a second receiving aperture 42 directed thereinto in a spaced orientation relative to the respective first receiving aperture 32. In this form of the invention, a pair of positioning means 18 are provided including a second adjustment screw 44 threadably directed through the mounting plates 36 and aligned with the second receiving aperture 42 of the first engaging plate 28. By this structure, the second adjustment screw 44 can be positioned in a desired orientation disparate relative to the orientation of the first adjustment screw 38 so as to allow an individual to select between either one of the positioning means 18 prior to insertion of a golf tee 16 into a ground surface. In other words, the positioning means 18 of the present invention 10 can each be set to a desired height prior to use of the device 10, whereby an individual may simply select one of the desired heights during use of the device 10 by simply placing the golf tee 16 into either of the first and second receiving apertures 32 and 42.

As best illustrated in FIG. 2, the invention may additionally comprise a spike or golfing tool 49 which is pivotally mounted to an offset portion of the second clamp plate 24 by a pivot axle 51 directed through and pivotally secured through both the golfing tool and the second clamp plate. The specific offset pivotal mounting of the golfing tool 49 permits either end of the golfing tool to be utilized by a simple rotation of the golfing tool about the pivot axle 51. Preferably, the pivot axle 51 frictionally retains the golfing tool 49 in a desired angular orientation relative to the clamp means 12 for use thereof.

As shown in the figures, the present invention 10, may further comprise a mounting means for securing the device to an object such as a golf bag, golf cart, golf, or other objects as desired. To this end, the mounting means preferably comprises a first portion 50 of hook and loop fabric fastening material such as is commonly known under the trademarked name "VELCRO" which is coupled to an exterior surface of one of the clamp plates 22 or 24. A second portion 52 of hook and loop fabric fastening material is provided with the mounting means and can be adhesively or otherwise secured to an auxiliary object, whereby cooperative engagement of the first portion 50 of hook and loop fabric fastening material with the second portion 52 will removably mount the present invention 10 relative to the object as desired.

In use, the adjustable tee setting device 10 of the present invention can be easily utilized for setting one or more tees at a desired height within a ground surface. To this end, a shaft 14 of a golf tee 16 can simply be placed between the receiving apertures 32 or 42 of the engaging plates 28 and 30 and captured therebetween through a manual compression of the clamp plates 22 and 24 together against a force of the resilient hinge 26. The head 20 of the golf tee 16 can then be engaged with the hemi-spherical head 40 of the respective adjustment screw 38 or 44 so as to position a desired amount of the shaft 14 of the golf tee 16 exteriorly of the clamp means 12. The clamp means 12 can then be moved towards a ground surface so as to facilitate forced insertion of the shaft 14 of the golf tee 16 thereinto, whereby abutting engagement of either or both of the engagement plates 28 and 30 against the ground surface will signal to a user the device 10 that the golf tee 16 has been inserted into the ground surface a desired distance.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable tee setting device comprising:

a clamp means for clamping a shaft of a golf tee;

a positioning means adjustably mounted relative to the clamp means for engaging a head of the golf tee so as to adjustably position the golf tee relative to the clamp means such that a predetermined amount of the shaft thereof projects beyond the clamp means for forced insertion into a ground surface;

the clamp means comprising a first clamp plate; a second clamp plate resiliently pivotally mounted to the first clamp plate by a resilient hinge extending therebetween; a first engaging plate mounted to a lower end of the first clamp plate and projecting towards the second clamp plate; at least one second engaging plate mounted to the lower end of the second clamp plate and projecting towards the first clamp plate, the first engaging plate including a receiving aperture directed thereinto which operates to receive a portion of the shaft of the golf tee when clamped between the clamp plates;

the positioning means comprising at least one mounting plate coupled to an interior surface of one of the clamp plates; an adjustment screw threadably directed through the mounting plate and aligned with the receiving aperture of the first engaging plate such that a longitudinal axis directed through the adjustment screw projects through the receiving aperture;

the resilient hinge being an integral bend extending between upper ends of the clamp plates; the at least one second engaging plate comprising a pair of second engaging plates coupled to the second clamp plate and positioned so as to extend along opposed sides of the first engaging plate as the second clamp plate is biased towards the first clamp plate;

the first engaging plate including a second receiving aperture directed thereinto in a spaced orientation relative to the first receiving aperture; a second positioning means including a second adjustment screw threadably directed through the mounting plate and aligned with the second receiving aperture of the first engaging plate such that a longitudinal axis directed through the second adjustment screw projects through the second receiving aperture;

a golfing tool being mounted to the clamp means, the golfing tool being pivotally mounted to an offset portion of the second clamp plate by a pivot axle directed through and pivotally secured through both the golfing tool and the second clamp plate, the pivot axle frictionally retains the golfing tool in a desired angular orientation relative to the clamp means thereof; and a mounting means for securing the device to an object, the mounting means comprising a first portion of hook and loop fabric fastening material coupled to an exterior surface of one of the clamp plates; and a second portion of hook and loop fabric fastening material configured for securing to an auxiliary object, whereby cooperative engagement of the first portion of hook and loop fabric fastening material with the second portion thereof will removably mount the device relative to the object when the second portion of hook and loop fabric fastening material is coupled to the object.

* * * * *